US010767862B2

(12) United States Patent
Ojiro et al.

(10) Patent No.: US 10,767,862 B2
(45) Date of Patent: Sep. 8, 2020

(54) FLAME ROD

(71) Applicant: Rinnai Corporation, Nagoya-shi, Aichi (JP)

(72) Inventors: Takashi Ojiro, Nagoya (JP); Kazuyuki Akagi, Nagoya (JP); Masaru Takeuchi, Nagoya (JP); Yoshinari Iwata, Kani (JP); Yoshiaki Miyajima, Kani (JP)

(73) Assignee: Rinnai Corporation, Nagoya-shi (JP)

( * ) Notice: Subject to any disclaimer, the term of this patent is extended or adjusted under 35 U.S.C. 154(b) by 147 days.

(21) Appl. No.: 16/030,920

(22) Filed: Jul. 10, 2018

(65) Prior Publication Data

US 2019/0017703 A1 Jan. 17, 2019

(30) Foreign Application Priority Data

Jul. 12, 2017 (JP) ..... 2017-136091

(51) Int. Cl.
*F23N 5/12* (2006.01)

(52) U.S. Cl.
CPC ..... *F23N 5/12* (2013.01); *F23N 2241/02* (2020.01); *F23N 2241/04* (2020.01)

(58) Field of Classification Search
CPC ..... H01H 1/00; F23N 4/12
USPC ..... 431/59; 426/523
See application file for complete search history.

(56) References Cited

U.S. PATENT DOCUMENTS 2,665,749 A * 1/1954 Ebeltoft ..... F23N 5/126 431/59
5,127,265 A * 7/1992 Williamson ..... B64F 1/005 150/154
5,227,135 A * 7/1993 Godec ..... G01N 21/766 422/98
2015/0292949 A1* 10/2015 Noda ..... H01L 37/02 250/338.3

FOREIGN PATENT DOCUMENTS

JP 02-7455 1/1990
JP 2003-232515 8/2003

* cited by examiner

*Primary Examiner* — Avinash A Savani
(74) *Attorney, Agent, or Firm* — Amin, Turocy & Watson, LLP

(57) ABSTRACT

A flame rod (1) including: a rod portion (11) made of a metal material containing aluminum; and a protective cover layer (21) containing a cover material having high conductivity and high heat resistance, wherein the protective cover layer (21) covers a surface of an insertion portion (11A) of the flame rod (11), and the protective cover layer (11) has a thickness of 0.002 mm or more and less than 0.1 mm.

5 Claims, 3 Drawing Sheets w/ LSM COVER LAYER w/o LSM COVER LAYER

FLAME ROD

CROSS-REFERENCE TO RELATED APPLICATION

The present application claims a priority based on a Japanese Patent Application No. 2017-136091 filed on Jul. 12, 2017, the content of which is hereby incorporated by reference in its entirely.

FIELD OF THE INVENTION

The present invention relates to a flame rod. Especially, the present invention relates to the flame rod used in a combustion device such as a water heater or a heat source device for a room heater.

BACKGROUND ART

A rod portion of a flame rod used in a combustion device such as a water heater or a heat source device for a room heater is exposed to flame of a burner to be heated at a temperature of 1,000 Celsius degrees or more. Thus, when the rod portion is made of a metal material containing aluminum, low electrically conductive alumina is deposited on a surface of the rod portion by an oxidation reaction of the aluminum due to repetitive combustion of the burner. Further, when the surface of the rod portion is covered with the alumina, a flame current flowing through the flame is hardly to be transmitted to the rod portion even in a state where the burner is combusted, resulting in detection failure.

In view of the above-described circumstances, conventionally, there has been known a flame rod formed with a ceramic cover layer made of a ceramic cover material having conductivity higher than the alumina, on a surface of an insertion portion that is inserted into flame. (For example, Patent Prior Art 1: Japanese Unexamined Patent Publication No. 2003-232515 A and Patent Prior Art 2: Japanese Unexamined Utility Model Publication No. H02-007455 U) According to the conventional flame rods described above, a flame current flowing through the flame is transmitted through the ceramic cover layer to an non-insertion portion that is disposed outside the flame.

In the flame rod having the ceramic cover layer described above, the rod portion and the ceramic cover layer are different in the thermal expansion coefficients. Thus, repetitive heating and cooling may result in cracking in the ceramic cover layer or peeling-off of the ceramic cover layer. As a result, the flame current flowing through the flame is hardly transmitted from the ceramic cover layer to the rod portion. In view of the above-described circumstances, according to the Patent Prior Art 1, the thermal expansion coefficient of the ceramic cover layer is made to approximate the thermal expansion coefficient of the rod portion made of the metal, so that the cracking in the ceramic cover layer and the peeling-off of the ceramic cover layer are reduced. Further, according to the Patent Prior Art 2, an intermediate coating layer is formed between the rod portion and the ceramic cover layer, so that the cracking in the ceramic cover layer and the peeling-off of the ceramic cover layer are reduced.

However, as described in the Patent Prior Art 1, in order to make the thermal expansion coefficient of the ceramic cover layer closer to that of the rod portion, it is necessary to adjust a thickness of the ceramic cover layer with a high precision. Therefore, it is necessary to precisely manage a coating amount of the cover material forming the ceramic cover layer, resulting in lowering productivity. As described in the Patent Prior Art 2, in a case where the intermediate coating layer is formed between the rod portion and the ceramic cover layer, manufacturing time becomes longer or number of manufacturing processes becomes larger, resulting in further lowering the productivity.

Particularly, according to the conventional flame rod of the Patent Prior Art 1, in order to secure conductivity, a thickness of the ceramic cover layer is set to be 0.1 mm or more. However, a more complicated process is needed to uniformly form the ceramic cover layer having the thickness of 0.1 mm or more, resulting in further lowering the productivity. Moreover, when the ceramic cover layer has such a thickness, heat is hardly to be transferred from the ceramic cover layer to the rod portion. As a result, a difference in degrees of heat expansion between the rod portion and the ceramic cover layer becomes large, whereby there is a problem in that the cracking in the ceramic cover layer and the peeling-off of the ceramic cover layer can not be prevented effectively.

SUMMARY OF INVENTION

The present invention has been achieved under the above circumstances, and an object of the present invention is to provide a flame rod excellent in conductivity and heat resistance used in a combustion device such as a water heater or a heat source device for a room heater with high productivity.

According to the present invention, there is provided a flame rod comprising:

a rod portion made of a metal material containing aluminum; and a protective cover layer containing a cover material having high conductivity and high heat resistance, wherein the protective cover layer covers a surface of at least an insertion portion of the rod portion, the insertion portion being inserted into flame, and the protective cover layer has a thickness of 0.002 mm or more and less than 0.1 mm.

According to the present invention, since the protective cover layer is hardly to be peeled off from the rod portion, the conductivity and the heat resistance can be maintained stably.

Moreover, according to the present invention, since the rod portion is doubly protected by an alumina layer and the protective cover layer, not only the heat resistance but corrosion resistance can be enhanced.

Further, since the thickness of the protective cover layer can be adjusted easily, there is no need of precise management of a concentration of the cover material. Therefore, the productivity can be enhanced.

Other objects, features and advantages of the present invention will become more fully understood from the detailed description given hereinbelow and the accompanying drawings which are given by way of illustration only, and thus are not to be considered as limiting the present invention.

DESCRIPTION OF EMBODIMENTS

Hereinafter, referring to drawings, an embodiment of the present invention will be described in detail.

Figure 1:
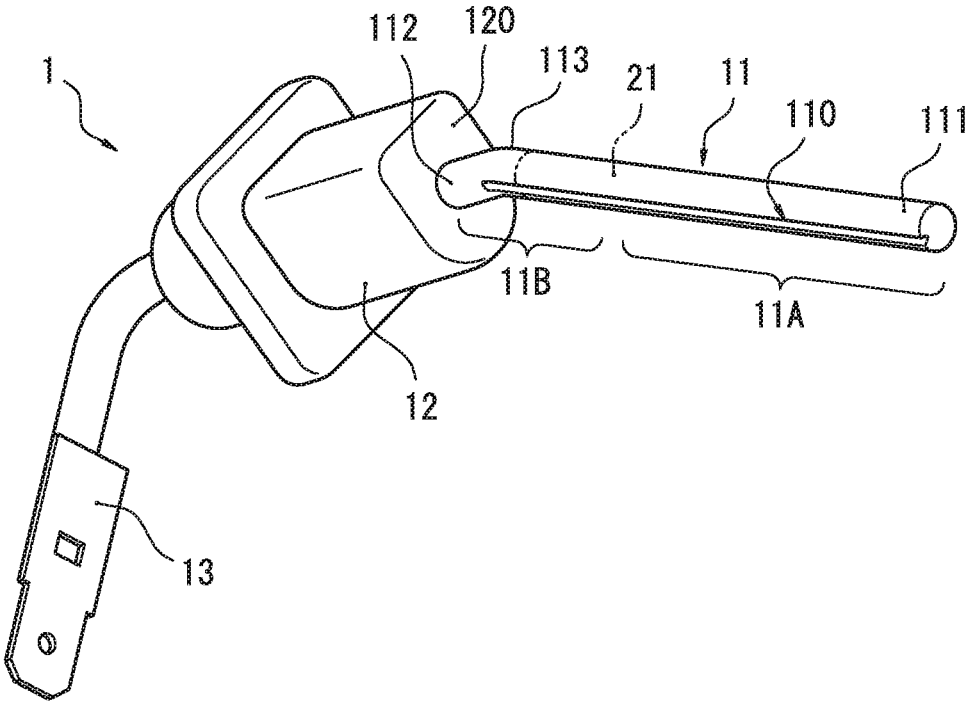
FIG. 1 is a perspective view showing one example of a flame rod according to an embodiment of the present invention.

As illustrated in FIG. 1, a flame rod 1 according to the present embodiment is mainly accommodated in a combustion device, such as a water heater or a heat source device for a room heater, and is used for detecting presence or absence of flame of a burner. The flame rod has a rod portion 11 to be inserted into the flame, an insulator 12 for supporting the rod portion 11, and a connecting terminal 13 for connecting an electric wire.

Although not shown, a flame detection circuit is accommodated in the combustion device. The flame detection circuit determines the presence or absence of the flame of the burner based on a current (a flame current) flowing between the flame rod 1 and the burner. The connecting terminal 13 is connected to the flame detection circuit via the electric wire. Further, the flame detection circuit is connected to the burner body via the electric wire. Thus, the flame rod 1 is electrically connected to the burner body via the flame detection circuit.

The flame detection circuit includes a power source for applying a certain voltage between the flame rod 1 and the burner body, and a current detection unit for detecting the flame current flowing between the flame rod 1 and the burner body through the flame. The flame detection circuit is configured so as to determine whether the flame is appropriately formed outside a flame port of the burner, by measuring the flame current when the certain voltage is applied between the flame rod 1 and the burner body.

The insulator 12 is supported and fixed to the a certain attachment portion inside the device in such a manner that a distal end 111 of the rod portion 11 faces the flame port of the burner from the outside. Insulation between the rod portion 11 and a rod support portion is ensured by the insulator 12.

The rod portion 11 is consisting essentially of a so-called SYTT metal alloy (Fe—Cr—Al—Y-based metal alloy) containing Fe, Cr, and Al as metal components. The rod portion 11 is made of a substantially column-shaped solid wire having high conductivity and high heat resistance.

The rod portion 11 extends from a rod connected portion 120 of the insulator 12 in a predetermined direction. Moreover, the rod portion 11 is bent at a predetermined portion close to a proximal end 112 at an obtuse angle. In this embodiment, the rod portion 11 is disposed in the combustion device in such a manner that a certain distal end side portion 11A from the distal end 111 to a bending portion 113 of the rod portion 11 is inserted into the flame. The distal end side portion 11A is provided from the distal end 111 to a position about ¾ length between the distal end 111 and the bending portion 113, for example. Namely, the distal end side portion 11A corresponds to an insertion portion, and a proximal end side portion 11B other than the distal end side portion 11A corresponds to an non-insertion portion.

The rod portion 11 has a groove 10 having a substantially V-shaped radial cross-section and extending from the distal end 111 to the bending portion 113. Specifically, the groove 110 is formed from the distal end side portion 11A to the proximal end side portion 11B in substantially parallel to an axis of the rod portion 11.

Figure 2:
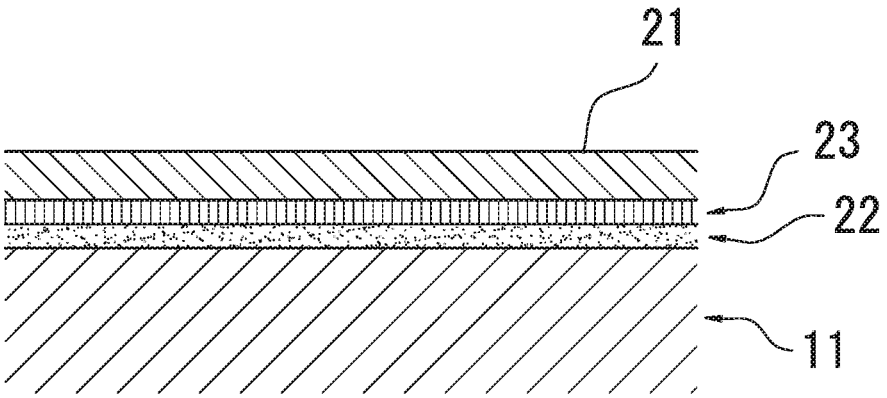
FIG. 2 is a schematic view showing one example of a surface structure of the flame rod according to the embodiment of the present invention.

A so-called LSM paint containing, as main components, lanthanum oxides (e.g., $La_2O_3$), strontium oxides (e.g., SrO), and manganese oxides (e.g., $MnO_2$) is coated on a surface of the rod portion 11, so that a lanthanum-strontium-manganese oxide cover layer 21 (hereinafter, referred to as "LSM cover layer") is formed on the surface from the distal end 111 to the bending portion 113. (See FIG. 2)

The LSM cover layer 21 is formed by immersing a certain region from the distal end 111 to the bending portion 113 into the LSM paint, and further drying and baking the coated member. Such a dip-coating method allows the LSM cover layer 21 having a uniform thickness to be readily formed without unevenness in the certain region of the rod portion 11. Moreover, since the rod portion 11 has the groove 10 on the surface thereof, when the dip-coating as described above is performed, a cover material of the LSM cover layer 21 is easily fixed to the groove 110 by smoothly coming into the groove 110.

The LSM cover layer 21 is formed on the surface of the rod portion 11 so as to have a thickness of 0.002 mm or more and less than 0.1 mm, preferably 0.007 mm or more and less than 0.03 mm. According to the dip-coating method described above, the thickness of the LSM cover layer 21 can be adjusted by immersing the rod portion 11 into the LSM paint once. Therefore, when the LSM cover layer 21 has the thickness within such a range, it makes possible to not only shorten a process time but reduce an amount of the LSM paint.

Further, when the LSM cover layer 21 has the thickness within such a range, oxygen can permeate the LSM cover layer 21 and reach the surface of the rod portion 11 easily. Thus, when the baking process are performed or the flame rod 11 is exposed to the flame of the burner, alumina is deposited at an interface between the rod portion 11 and the LSM cover layer 21 to form a thin alumina layer 22. Moreover, the cover material forming the LSM layer 21 intrudes into the alumina layer 22. As a result, a conductive alumina-manganese compound layer 23 composed of alumina ($Al_2O_3$) and manganese (Mn) is formed between the alumina layer 22 and the LSM cover layer 21, for example. (See FIG. 2) Namely, according to the embodiment, the alumina layer 22 and the alumina-manganese compound layer 23 are formed in order from a rod portion side at the interface between the rod portion 11 and the LSM cover layer 21.

Figure 3A:
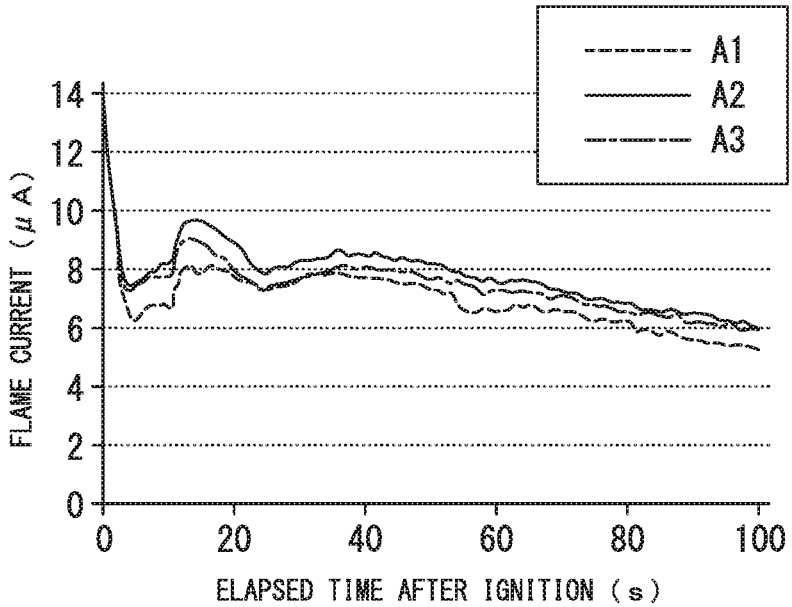
FIG. 3(A) is a graph showing time-dependent changes in flame current of the flame rod provided with a LSM cover layer under different use conditions.
Figure 3B:
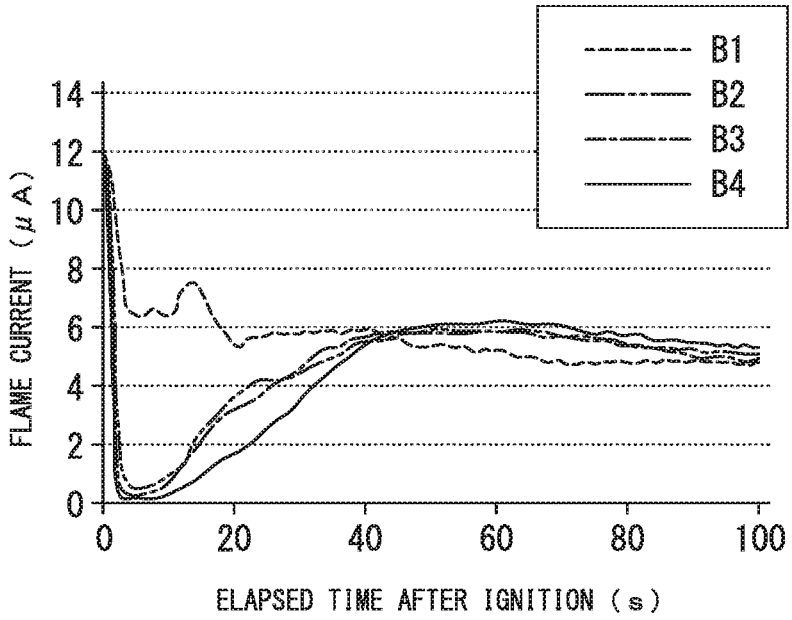
FIG. 3(B) is a graph showing time-dependent changes in flame current of a flame rod provided without a LSM cover layer under different use conditions.

FIG. 3(A) is a graph showing time-dependent changes in flame current of the flame rod 1 according to the present invention, measured under different use conditions, and FIG. 3(B) is a graph showing time-dependent changes in flame current of a comparative flame rod without the LSM cover layer on a surface of a rod portion, measured under different use conditions. The LSM cover layer 21 of the flame rod 1 used for tests shown in FIG. 3(A) has the thickness of 0.007 mm or more and less than 0.03 mm. Specifically, in FIG. 3(A), (A1) shows the time-dependent change in flame current of the flame rod 1 at an initial stage after start of use, (A2) shows the time-dependent change in flame current of the flame rod 1 after the flame rod 1 was continuously used for about 1,000 hours, and (A3) shows the time-dependent change in flame current of the flame rod 1 after a heat cycle test in which a cycle of turning on and off the burner every predetermined time (here, every 1 minute), was conducted at about 20,000 times. On the other hand, in FIG. 3(B), (B1) shows the time-dependent change in flame current of the comparative flame rod at an initial stage after start of use, (B2) shows the time-dependent change in flame current of the comparative flame rod after the comparative flame rod was continuously used for about 100 hours, (B3) shows the time-dependent change in flame current of the comparative flame rod after the comparative flame rod was continuously used for about 1,000 hours, and (B4) shows the time-dependent change in flame current of the comparative flame rod after the comparative flame rod was continuously used for about 2,000 hours.

As is understood from the time-dependent changes in flame current of the comparative flame rod, when igniting the burner, there is no significant decrease in flame current in the comparative flame rod at the initial stage after start of use (B1). However, when igniting the burner, there are significant decreases in flame current in the comparative flame rod with long use period (B2 to B4). Thus, when the comparative flame rod is used, there can be detection failure of the flame as an use period is longer. On the other hand, according to the flame rod 1 of the present invention, even after the long use period or repeating the heat cycle a number of times, the time-dependent changes in flame current of the flame rod 1 are almost same as that of the flame rod 1 at the initial stage after start of use (A1 to A3). Moreover, according to the flame rod 1 of the present invention, when igniting the burner, there are no significant decreases in flame current under any use conditions (A1 to A3). Accordingly, even when the use period is longer, the detection failure of the flame can be hardly occurred.

As described above, when the LSM cover layer 21 covering the surface of the insertion portion of the rod portion 11 (i.e., the distal end side portion 11A) has the thickness of 0.002 mm or more and less than 0.1 mm, bonding strength of particles of the cover material constituting the LSM cover layer 21 to the rod portion 11 becomes larger than bonding strength of the particles to one another. As a result, even when expansion and contraction are repeated due to heat, the LSM cover layer 21 is hardly peeled off from the rod portion 11, whereby conductivity and heat resistance can be maintained stably.

Also, when the thickness of the LSM cover layer 21 is within such a range, the heat is easily transferred from the LSM cover layer 21 to the rod portion 11. Thus, when the flame rod 1 is exposed to the flame of the burner to be heated at a high temperature, a difference in degrees of heat expansion between the rod portion 11 and the LSM cover layer 21 is hardly to be large. As a result, the cracking in the LSM cover layer 21 and the peeling-off of the LSM cover layer 21 can be prevented effectively. Accordingly, the conductivity and the heat resistance can be maintained further stably.

Further, since the above effects can be obtained by setting the thickness of the LSM cover layer 21 within such a range, there is no need to take care of the degree of the heat expansion of the rod portion 11. Thus, the thickness of the LSM cover layer 21 can be adjusted easily, and precise management of a concentration of the cover material is not needed. Accordingly, manufacturing time and number of manufacturing processes can be reduced. With this configuration, productivity can be enhanced.

Furthermore, the thin alumina layer 22 is formed at the interface between the rod portion 11 and the LSM cover layer 21 as the use period is longer. Accordingly, since the rod portion 11 is doubly protected by the alumina layer 22 and the LSM cover layer 21, the heat resistance and corrosion resistance can be further enhanced.

Moreover, since the alumina layer is formed under the thin LSM layer 21, the conductive alumina-manganese compound layer 23 is formed between the alumina layer 22 and the LSM cover layer 21. Accordingly, even if the cracking in the LSM cover layer 21 or the peeling-off of the LSM cover layer 21 is occurred, the conductivity can be maintained.

Further, the rod portion 11 has the groove 110 extending from the distal end side portion 11A (the insertion portion) to the proximal end side portion 11B (the non-insertion portion). Thus, when the rod portion 11 is covered with the LSM cover layer 21, the cover material forming the LSM cover layer 21 comes into the groove 110 to be easily fixed to the groove 110. Accordingly, a conduction path for the flame current is stably formed over an entire region from the insertion portion to the non-insertion portion. With this configuration, the conductivity can be stably maintained.

Furthermore, the LSM cover layer 21 formed in the groove 110 is hardly influenced by the expansion and contraction of the rod portion 11, as compared with the LSM cover layer 21 formed on the surface of the rod portion 11 other than the groove 110. Thus, even if the use period is longer, the cracking in the LSM cover layer 21 or the peeling-off of the LSM cover layer 21 is hardly occurred. Accordingly, the conduction path for the flame current is stably secured, whereby the conductivity can be more stably maintained.

In the embodiment described above, the groove 110 formed on the surface of the rod portion 11 extends in substantially parallel to the axis of the rod portion 11. However, a shape of the groove 110 is not particularly limited as long as the groove 110 is continuously formed from the insertion portion to the non-insertion portion and the conduction path for the flame current can be secured. For example, the groove 110 having other shapes such as spiral shape, arc shape, and corrugated shape may be formed on the surface of the rod portion 11. Further, the groove 110 is not limited to a single number, but a plurality of them may be formed.

Moreover, in the embodiment described above, the LSM cover layer 21 is formed by the dip-coating method. However, a manufacturing method is not limited as long as the LSM cover layer 21 having a uniform thickness can be formed without unevenness in the certain region of the rod portion 11. For example, the LSM cover layer 21 may be formed by other coating methods such as spray coating method.

As described in detail, the present invention is summarized as follows.

According to the present invention, there is provided a flame rod comprising:

a rod portion made of a metal material containing aluminum; and a protective cover layer containing a cover material having high conductivity and high heat resistance, wherein the protective cover layer covers a surface of at least an insertion portion of the rod portion, the insertion portion being inserted into flame, and the protective cover layer has a thickness of 0.002 mm or more and less than 0.1 mm.

In this type of flame rod, the protective cover layer is a stack of fine particles. Strength of the stack is maintained by partially bonding of particles to one another. Moreover, adhesion of the stack to the rod portion is maintained by intruding the particles into small recesses formed on the surface of the rod portion. Further, as described above, the repetitive expansion and contraction of the protective cover layer occurs due to the heat. Thus, when the protective cover layer is too thick, the bonding strength of the particles to one another becomes larger than the bonding strength of the particles to the rod portion. As a result, the protective cover layer can be easily peeled off from the rod portion. On the other hand, when the protective cover layer is too thin, the bonding strength of the particles to one another reduces. Accordingly, in a case where the protective cover layer is too thick or thin, the cracking in the protective cover layer or the peeling-off from the protective cover layer is easily occurred by the repetitive expansion and contraction due to the heat.

However, according to the flame rod of the present invention, the protective cover layer covers the surface of at least the insertion portion of the rod portion and has the thickness of 0.002 mm or more and less than 0.1 mm. Thus, even when the expansion and contraction are repeated due to the heat, the bonding strength of the particles to the rod portion becomes larger than the bonding strength of the particles to one another, whereby the protective cover layer is hardly peeled off from the rod portion. Further, when the thickness of the protective cover layer is within such a range, the heat is easily transferred from the protective cover layer to the rod portion. Thus, the difference in degrees of heat expansion between the rod portion and the protective cover layer is hardly to be large. As a result, the cracking in the protective cover layer and the peeling-off of the protective cover layer can be prevented effectively.

Furthermore, since the cracking in the protective cover layer and the peeling-off of the protective cover layer can be prevented by setting the thickness of the protective cover layer within such a range, there is no need to take care of the degree of the heat expansion of the rod portion. Thus, the thickness of the protective cover layer can be adjusted easily. Further, the precise management of the concentration of the cover material is not needed. Accordingly, the manufacturing time and number of manufacturing processes for forming the protective cover layer on the surface of the rod portion can be reduced.

On the other hand, while the alumina deposited on the surface of the rod portion decreases the conductivity of the rod portion, it enhances the heat resistance and corrosion resistance of the rod portion. Thus, when the protective cover layer having a thickness thicker than the above range is formed on the surface of the rod portion in view of securing the conductivity, same as the conventional flame rod, oxygen in the air hardly permeates the protective cover layer. As a result, the alumina is hardly deposited on the surface of the rod portion. However, according to the present invention, when the protective cover layer has the thickness within the range described above, the oxygen can permeate the protective cover layer and reach the surface of the rod portion easily. As a result, the thin alumina layer is formed at the interface between the protective cover layer and the rod portion as the use period becomes longer. Accordingly, the rod portion is doubly protected by the alumina layer and the protective cover layer, resulting in enhancing the heat resistance and the corrosion resistance.

Preferably, in the flame rod described above, the cover material of the protective cover layer contains lanthanum-strontium-manganese oxide.

According to the flame rod described above, lanthanum-strontium-manganese oxide particles intrude into the alumina layer formed on the surface of the rod portion. As a result, the conductive alumina-manganese compound layer composed of alumina and manganese is formed between the alumina layer and the LSM cover layer. Accordingly, even if the cracking in the protective cover layer or the peeling-off of the protective cover layer is occurred, the conductivity can be maintained.

Preferably, in the flame rod described above, the rod portion has a groove extending from the insertion portion to an non-insertion portion on the surface thereof, the non-insertion portion being disposed outside the flame.

According to the flame rod described above, when the protective cover layer covers the surface of the rod portion, the cover material of the protective cover layer comes into the groove, whereby the cover material can be easily fixed to the groove. Thus, the conduction path for the flame current is stably formed over the entire region from the insertion portion to the non-insertion portion. Further, the protective cover layer formed in the groove is hardly influenced by the expansion and contraction of the rod portion, as compared with the protective cover layer formed on the surface of the rod portion other than the groove. Thus, even if the use period becomes longer, the cracking in the protective cover layer and the peeling-off of the protective cover layer is hardly occurred. Accordingly, the conduction path for the flame current is more stably secured.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A flame rod comprising:

a rod portion made of a metal material containing aluminum; and a protective cover layer containing a cover material having high conductivity and high heat resistance, wherein the protective cover layer covers a surface of at least an insertion portion of the rod portion, the insertion portion being inserted into flame, the protective cover layer has a thickness of 0.002 mm or more and less than 0.1 mm, and the rod portion has a groove extending from the insertion portion to a non-insertion portion on the surface thereof, the non-insertion portion being disposed outside the flame.

2. The flame rod according to claim 1, wherein the cover material of the protective cover layer contains lanthanum-strontium-manganese oxide.

3. The flame rod according to claim 2, further comprising an alumina layer and an alumina-manganese compound layer in order from a rod portion side at an interface between the rod portion and the protective cover layer.

4. A flame rod comprising:

a rod portion made of a metal material containing aluminum;

a protective cover layer containing a cover material having high conductivity and high heat resistance, the cover material containing lanthanum-strontium-manganese oxide; and an alumina layer and an alumina-manganese compound layer in order from a rod portion side at an interface between the rod portion and the protective cover layer, wherein the protective cover layer covers a surface of at least an insertion portion of the rod portion, the insertion portion being inserted into flame, and the protective cover layer has a thickness of 0.002 mm or more and less than 0.1 mm.

5. The flame rod according to claim 4, wherein the rod portion has a groove extending from the insertion portion to a non-insertion portion on the surface thereof, the non-insertion portion being disposed outside the flame.

* * * * *